US007681879B2

(12) United States Patent
Fuchi

(10) Patent No.: US 7,681,879 B2
(45) Date of Patent: Mar. 23, 2010

(54) SHEET FEEDER AND IMAGE FORMING APPARATUS

(75) Inventor: Masami Fuchi, Osaka (JP)

(73) Assignee: Kyocera Mita Corporation (JP)

( * ) Notice: Subject to any disclaimer, the term of this patent is extended or adjusted under 35 U.S.C. 154(b) by 71 days.

(21) Appl. No.: 11/904,218

(22) Filed: Sep. 26, 2007

(65) Prior Publication Data

US 2008/0079216 A1 Apr. 3, 2008

(30) Foreign Application Priority Data

Sep. 28, 2006 (JP) ..... 2006-265781

(51) Int. Cl.
*B65H 1/00* (2006.01)

(52) U.S. Cl. ..... 271/162; 271/157; 271/164; 271/152; 271/153

(58) Field of Classification Search ..... 271/157, 271/162, 164, 149, 152, 153
See application file for complete search history.

(56) References Cited

U.S. PATENT DOCUMENTS 4,033,578 A * 7/1977 Taylor et al. ..... 271/157
4,660,823 A * 4/1987 Sato ..... 271/22
5,046,715 A * 9/1991 Taniguchi et al. ..... 271/164
5,149,079 A * 9/1992 Iwamoto et al. ..... 271/162
5,203,552 A * 4/1993 Hoshi et al. ..... 271/9.01
5,294,105 A * 3/1994 Kaburagi et al. ..... 271/157
5,335,901 A * 8/1994 Nonomura et al. ..... 271/117
5,411,246 A * 5/1995 Nonomura et al. ..... 271/117
5,441,246 A * 8/1995 Miyata et al. ..... 271/9.11
5,794,928 A * 8/1998 Araseki et al. ..... 271/9.08
6,286,827 B1 * 9/2001 Meetze et al. ..... 271/162
6,334,610 B1 * 1/2002 Minamishin et al. ..... 271/3.04
6,698,747 B2 * 3/2004 Dobbertin et al. ..... 271/30.1
2002/0074714 A1 * 6/2002 Yow et al. ..... 271/162
2003/0015836 A1 * 1/2003 Westcott et al. ..... 271/152
2007/0273083 A1 * 11/2007 Imai ..... 271/152

FOREIGN PATENT DOCUMENTS

JP 2931086 8/1999
JP 2008013357 A * 1/2008

* cited by examiner

*Primary Examiner*—Patrick H Mackey
*Assistant Examiner*—Prasad V Gokhale
(74) *Attorney, Agent, or Firm*—Gerald E. Hespos; Anthony J. Casella

(57) ABSTRACT

A sheet feeder is provided with a sheet accommodating portion, an elevating plate and an inclining mechanism. The sheet accommodating portion includes a bottom plate and a plurality of side plates provided perpendicular to the bottom plate, and can accommodate a plurality of sheets. The sheets accommodated in the sheet accommodating portion are successively fed to the outside from the uppermost one. The elevating plate is movable upward and downward and used to stack the sheets in the sheet accommodating portion. The inclining mechanism inclines the elevating plate such that the front ends of the sheets with respect to a sheet feeding direction are inclined downward during sheet feeding.

14 Claims, 6 Drawing Sheets

SHEET FEEDER AND IMAGE FORMING APPARATUS

BACKGROUND OF THE INVENTION

1. Field of the Invention

The present invention relates to a sheet feeder for feeding sheets, and an image forming apparatus such as a copier, a facsimile machine or a printer equipped with such a sheet feeder.

2. Description of the Related Art

Conventionally, a sheet feeder for feeding sheets has been used in an image forming apparatus. Generally, a sheet feeder is equipped in an image forming apparatus and feeds sheets stacked therein to the image forming apparatus while separating the sheets one by one from the uppermost sheet using a pickup roller. For examples, large-capacity sheet feeders externally attached to image forming apparatuses, sheet cassettes provided in main bodies of image forming apparatuses and the like exist as modes of sheet feeders.

In these sheet feeders, there are cases where an elevating plate movable upward and downward is disposed in a sheet accommodating portion. In a sheet feeder accommodating a relatively large amount of sheets, the elevating plate is frequently used. Sheets are stacked on this elevating plate. The elevating plate is elevated little by little so as to bring the uppermost one of the stacked sheets into contact with a pickup portion such as a pickup roller during a sheet feeding operation.

On the other hand, the elevating plate is lowered upon replenishing sheets. Some elevating plates are lowered straight to a lower limit position, and some elevating plates are gradually lowered every time sheets are replenished so that the elevating plate or the uppermost position of the stacked sheets is located at such a height as to enable easy sheet replenishment for users. After the completion of the sheet replenishment, the elevating plate is elevated to bring the uppermost sheet into contact with the pickup portion.

Japanese Patent No. 2931086 (D1) proposes an example of such a sheet feeder. D1 discloses that, in a large-capacity sheet feeder for feeding sheets stacked on a bottom plate of a tray movable upward and downward from the uppermost one by means of a sheet feeding mechanism, an inclined portion inclined upward in a sheet feeding direction is provided at a leading end portion of the tray bottom plate. By such a construction, compatibility between the large-capacity sheet feeder and a sheet cassette is improved, and an attempt is made to avoid a sheet jam and the like by enabling a sheet to be brought at a suitable angle to a feed roller present downstream of a pickup roller in the sheet feeding direction.

It has been a conventional and general practice to stack sheets in a sheet feeder such that the leading ends of the sheets in a sheet feeding direction are inclined upward or at least held horizontal. This is because, as disclosed in D1, the sheets are thought to be more stably fed with the leading ends of the sheets extending upward in view of the multiple feed of sheets and the like.

However, if the leading ends of the sheets are lifted up, sheets in an uppermost part of the sheet stack might be displaced backward. Then, it is no longer possible to reliably bring the uppermost sheet into contact with the pickup portion, thereby presenting a problem of being unable to precisely feed the sheets. This problem causes a sheet jam and the like.

Further, in order to precisely move the elevating plate provided in the sheet feeder capable of accommodating a large amount of sheets upward and downward, it is necessary to accurately detect the position of the uppermost part of the sheet stack. However, if the sheets in the uppermost part of the sheet stack are displaced backward, there is an addition problem of being unable to make an accurate detection in some cases.

Specifically, in the case of elevating the elevating plate to bring the uppermost one of the stacked sheets into contact with the pickup portion, the position of the uppermost sheet might be erroneously detected if the sheets are displaced backward. Such an error detection causes problems that a sheet other than the uppermost one is brought into contact with the pickup portion with the uppermost sheet left displaced backward and the elevating plate is excessively elevated. These problems cause a pickup error, a delay in feed timing, a sheet jam and the like.

On the other hand, upon gradually lowering the elevating plate such that the uppermost one of the already stacked sheets is at such a height enabling easy replenishment for a user during a sheet replenishing operation, the elevating plate might be stopped without being sufficiently lowered before reaching an originally determined amount of downward movement. This troubles the sheet replenishing operation of the user.

Since the upward inclined portion in the sheet feeding direction is provided at the leading end portion of the tray bottom plate in the sheet feeder of D1, sheets in the uppermost part of the sheet stack might be displaced backward. Further, the invention according to D1 aims to improve the compatibility between the large-capacity sheet feeder and the sheet cassette and to enable the sheet to be brought at a suitable angle to the feed roller, and does not consider the above problems at all.

SUMMARY OF THE INVENTION

An object of the present invention is to provide a sheet feeder capable of preventing sheets in an uppermost part of a sheet stack-therein from being displaced backward with respect to a sheet feeding direction and accurately detecting the uppermost part of the sheet stack, and an image forming apparatus using such a sheet feeder.

In order to accomplish this object, one aspect of the present invention is directed to a sheet feeder comprising a sheet accommodating portion including a bottom plate and a plurality of side plates provided perpendicular to the bottom plate, and being capable of accommodating a plurality of sheets, the accommodated sheets being successively fed to the outside from the uppermost one; an elevating plate provided to stack the sheets in the sheet accommodating portion and movable upward and downward; and an inclining mechanism for inclining the elevating plate such that the front ends of the sheets are inclined downward in a sheet feeding direction during sheet feeding.

Another aspect of the present invention is directed to an image forming apparatus, comprising an apparatus main body for performing an image forming operation to sheets; and a sheet feeder for feeding the sheets to the apparatus main body, wherein the sheet feeder has the construction of the above sheet feeder.

These and other objects, features, aspects and advantages of the present invention will become more apparent upon a reading of the following detailed description with reference to accompanying drawings.

DETAILED DESCRIPTION OF THE PREFERRED EMBODIMENTS

Hereinafter, one embodiment of the present invention is described with reference to FIGS. 1 to 6. A sheet feeder 1 illustrated in this embodiment is the one externally attached to an image forming apparatus 2 (apparatus main body) and having a large capacity capable of accommodating several thousands sheets P. It should be appreciated that features such as the construction, arrangement and the like disclosed in this embodiment are merely examples and do not limit the scope of the present invention.

Figure 1:
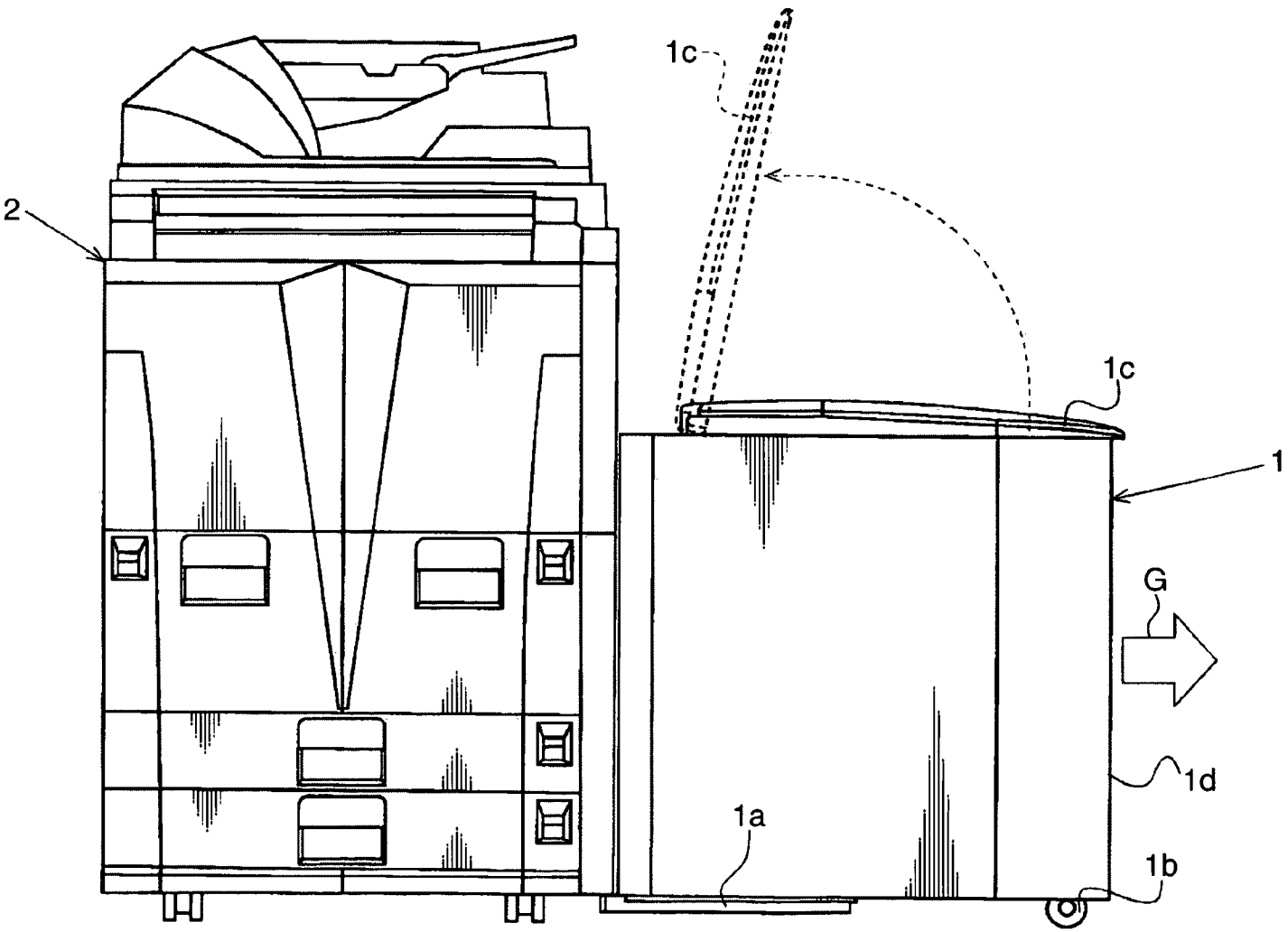
FIG. 1 is a front view in the case where a sheet feeder according to one embodiment of the present invention is attached to an image forming apparatus.
Figure 2:
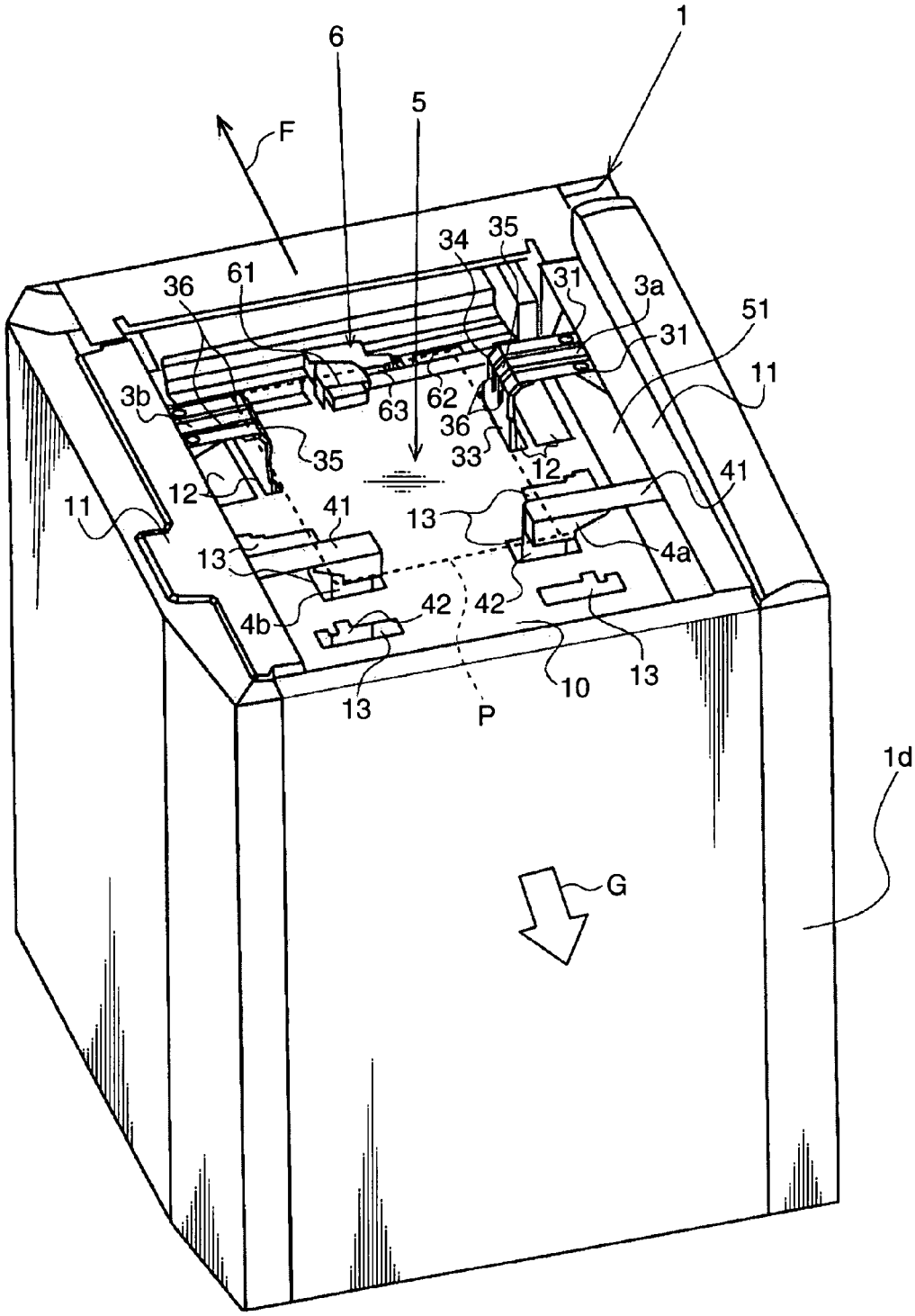
FIG. 2 is a perspective view of the sheet feeder when viewed from an upper left side.
Figure 3:
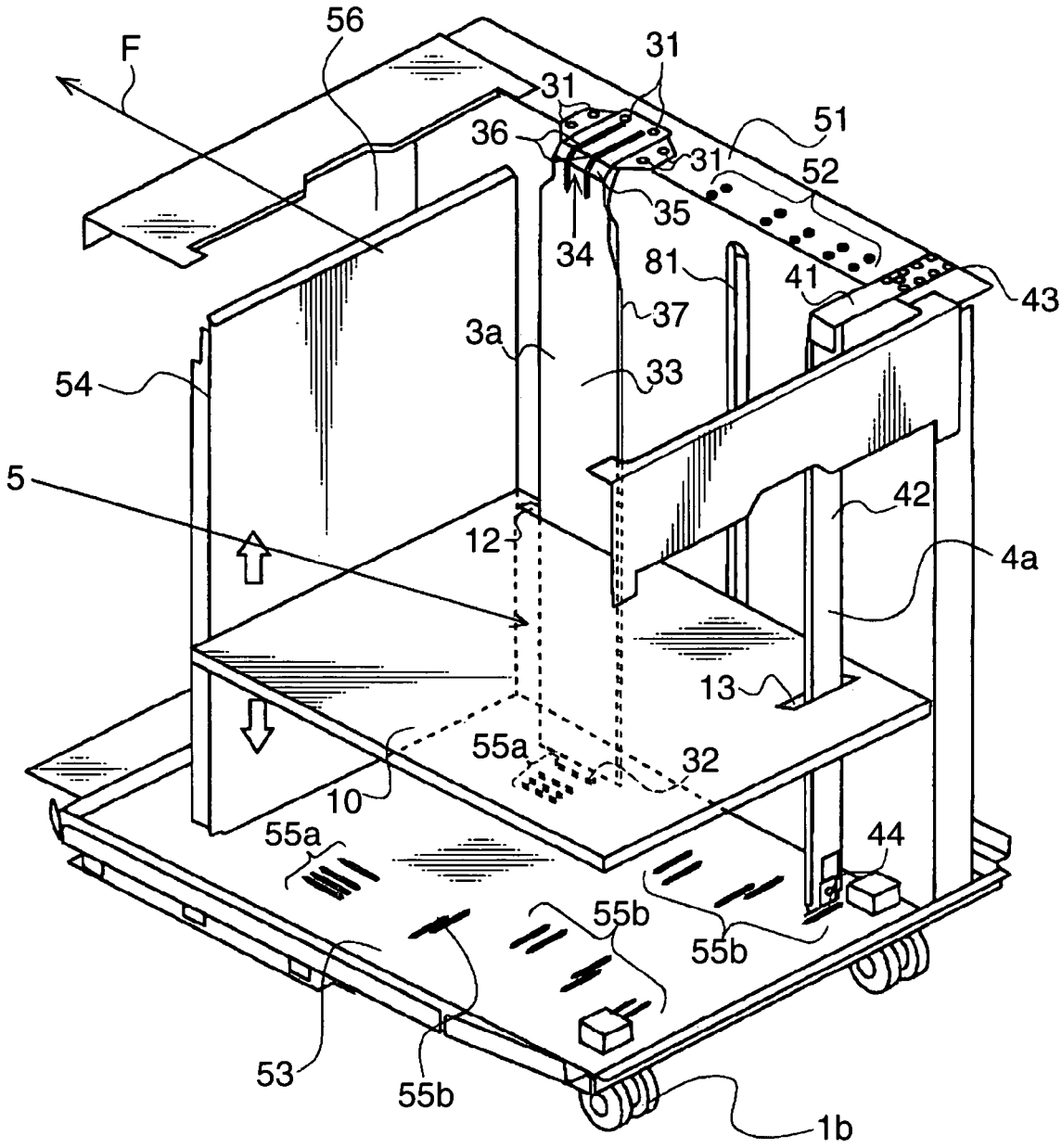
FIG. 3 is a perspective view of the sheet feeder when viewed from a front left side.

First, with reference to FIGS. 1 to 3, the sheet feeder 1 according to the embodiment of the present invention is schematically described. FIG. 1 is a front view in the case where the sheet feeder 1 according a first embodiment of the present invention is attached to the image forming apparatus 2. FIG. 2 is a perspective view of the sheet feeder 1 when viewed from an upper left side. FIG. 3 is a perspective view showing the internal construction of the sheet feeder 1 when viewed from a front left side.

As shown in FIG. 1, the sheet feeder 1 according to this embodiment is attached to a side surface of the image forming apparatus 2 (copier). Although the detailed construction of the sheet feeder 1 is described later, the sheet feeder 1 according to this embodiment is capable of accommodating about four thousands sheets P. The sheets P stacked in the sheet feeder 1 are fed one by one to the image forming apparatus 2, which forms images on the received sheets P.

Any desired image forming method of the image forming apparatus 2 can be selected from an electrophotographic method, an electrostatic recording method, an ink jet method and the like. For example, in the case of adopting the electrophotographic method, the image forming apparatus 2 is constructed to include a photoconductive drum, a charger, an exposing device, a developing device, a cleaner, a fixing device, etc.

The photoconductive drum is disposed rotatably about its shaft center and has an electrostatic latent image and a toner image formed on the outer circumferential surface thereof while being rotated. The toner image on this outer circumferential surface is transferred to the sheet P to form an image on the sheet P.

The charger uniformly charges the outer circumferential surface of the photoconductive drum. The exposing device irradiates the uniformly charged outer circumferential surface of the photoconductive drum with a beam based on image information of a document image read by an image reader, thereby forming an electrostatic latent image. The developing device forms a toner image by supplying toner particles to the electrostatic latent image formed on the outer circumferential surface of the photoconductive drum. The cleaner cleans the outer circumferential surface of the photoconductive drum by removing the toner residual on the outer circumferential surface of the photoconductive drum after an operation of transferring the toner image to the sheet. The fixing device fixes the toner image to the sheet having the toner image transferred from the outer circumferential surface of the photoconductive drum and includes, for example, a fixing roller internally provided with a heating element and a pressure roller whose outer circumferential surface is held in contact with the outer circumferential surface of the fixing roller.

The sheet feeder 1 includes slide rails 1*a* and casters 1*b* at the bottom and is movable along a direction shown by an outline arrow G (same in FIG. 2) in FIG. 1 so as to be movable toward and away from the image forming apparatus 2. Upon an occurrence of a jam (sheet jam) during the conveyance of the sheet P from the sheet feeder 1 toward the image forming apparatus 2, a jam processing of removing the jammed sheet can be performed with the sheet feeder 1 detached from the image forming apparatus 2.

A lid 1*c* is provided on the upper surface of the sheet feeder 1. A supporting point is provided in a direction normal to the plane of FIG. 1 near the left end of the lid 1*c* in FIG. 1. The lid 1*c* can be opened and closed. The lid 1*c* in an open state is shown in broke line in FIG. 1. If the lid 1*c* of the sheet feeder 1 is open, the upper side of the sheet feeder 1 is exposed and a user can replenish the sheet feeder 1 with sheets P from above.

Next, the construction of the sheet feeder 1 is described with reference to FIGS. 2 and 3. It should be noted that the lid 1*c* is not shown in FIG. 2 in order to facilitate the description.

As shown in FIG. 2, the sheet feeder 1 according to this embodiment is provided with two width restricting guides 3*a*, 3*b* extending in a direction parallel to a sheet feeding direction (direction shown by an arrow F: same in FIGS. 3 to 5) and adapted to restrict the position of the sheets P in width direction, rear end guides 4*a*, 4*b* for restricting the rear end position of the sheets P in a direction normal to the sheet feeding direction, a sheet accommodating portion 5 (see FIG. 3) contained in a housing 1*d* of the sheet feeder 1, a feeding unit 6 including a pickup portion 61 for feeding the stacked sheets one by one toward the image forming apparatus 2 and various sensors for confirming a stacked state of the sheets P, an elevating plate 10 on which the sheets P are placed, decorative laminates 11 and the like.

The width restricting guides 3*a*, 3*b* are formed by bending plate-like members, have a substantially L-shaped vertical cross section and restrict the sheets P in a direction parallel to the sheet feeding direction. The width restricting guides 3*a*, 3*b* are, for example, formed of a steel plate. It should be noted that holes 31 are formed near the upper ends of the width restricting guides 3*a*, 3*b*. Further, inserting portions 32 are provided at the bottom ends of the width restricting guides 3*a*, 3*b* (see FIG. 3). These holes 31 and inserting portions 32 are provided to support the width restricting guides 3*a*, 3*b*, and this point is described in detail later.

The width restricting guides 3*a*, 3*b* have slants 35 at upper ends 34 of contact surfaces 33 to be brought into contact with the sheets P. By having the slants 35, the user can place his hand holding the sheets P to be replenished on the slant 35 during the replenishment of sheets, thereby being able to ensure a hand placing space during the replenishment of sheets. Thus, an operation of replenishing the sheet feeder 1 with sheets can be easily performed. It should be noted that the angle of the slants 35 can be suitably set.

Further, each of the width restricting guides 3*a*, 3*b* is formed with two ribs 36 extending in an inserting direction of the sheets P from the contact surface 33 with the sheets P, to the slant 35 and to the upper ends of the width restricting guide 3*a*, 3*b*. As compared to the case where the upper ends of the contact surfaces 33 are at right angles, friction between the width restricting guides 3*a*, 3*b* and the sheets P becomes larger if the sheets P to be replenished are placed on the slants 35 during the replenishment of sheets. However, if one or more ribs 36 are provided, resistance resulting from such friction can be largely reduced.

The rear end guides 4*a*, 4*b* are for restricting the rear end position of the sheets P in the direction normal to the sheet feeding direction. Structurally, each rear end guide 4*a*, 4*b* is formed by bonding two members, i.e. an engaging member 41 to be fixed to the sheet feeder 1 and a rear-end guiding member 42 for restricting the position by coming into contact with the rear end of the sheets P.

Each engaging member 41 is formed with a plurality of holes 43 in order to be engaged with engaging portions 52 provided on the upper end of each opposite side plate 51 of the sheet accommodating portion 5 (see FIG. 3). Each rear-end guiding member 42 is formed by combining two members having U-shaped horizontal cross sections. This ensures the strengths of the rear end guides 4*a*, 4*b*. The rear-end guiding members 42 and engaging members 41 can be bonded by means of rivets, screws, welding or the like.

Inserting portions 44 are provided at the bottom ends of the rear-end guiding members 42 (see FIG. 3). The inserting portions 44 and the aforementioned holes 43 are provided to support the rear-end guides 4*a*, 4*b*, and this point is described in detail later.

The elevating plate 10 is constructed to be movable in vertical direction. A construction for driving the elevating plate 10 is described in detail later. The sheets P are stacked on this elevating plate 10 (stacked position of the sheets P is shown in broken line in FIG. 2) and the elevating plate 10 is elevated little by little every time the sheets P decrease in number. The uppermost one of the stacked sheets P is constantly in contact with the pickup portion 61. It should be noted that FIG. 2 shows a state where the elevating plate 10 is at an uppermost position.

In this embodiment, the elevating plate 10 is formed with four through holes 12 through which the width restricting guides 3*a*, 3*b* are inserted and six through holes 13 through which the rear end guides 4*a*, 4*b* are inserted. By such a construction, the width restricting guides 3*a*, 3*b* and rear end guides 4*a*, 4*b* can restrict the position of the stacked sheets P from the bottom to the top of the sheet feeder 1. Further, since a plurality of through holes 12, 13 are formed, supported positions of the width restricting guides 3*a*, 3*b* and rear end guides 4*a*, 4*b* can be switched. This enables sheets P of various sizes such as A4, A3, B5 and B4 to be stacked in the sheet feeder 1.

The decorative laminates 11 are so arranged as to cover the engaging portions 52 of the sheet accommodating portion 5 to be described later (see FIG. 3), and can be detached in view of the position switch of the width restricting guides 3*a*, 3*b* and rear end guides 4*a*, 4*b* for a change in the size of sheets to be accommodated.

Next, the internal construction of the sheet feeder 1 and the construction of the sheet accommodating portion 5 are described in detail with reference to FIG. 3. In FIG. 3, in order to facilitate the description, the internal construction of only a back side when viewed from front is shown without showing the width restricting guide 3*b* and the rear end guide 4*b* out of a total of four members for restricting the position of the sheet P (see FIG. 2) and one side plate 51 (described later). The construction of a front side when viewed from front is similarly constructed.

As shown in FIG. 3, the sheet accommodating portion 5 is provided in the housing 1*d* of the sheet feeder 1 according to this embodiment.

The sheet accommodating portion 5 is comprised of a bottom plate 53, the side plates 51 arranged in parallel with the sheet feeding direction shown by the arrow F in FIG. 3, a front plate 54 arranged below a sheet discharge port 56 in a direction normal to the sheet feeding direction so as to be brought into contact with the front ends of the stacked sheets P in the sheet feeding direction. The side plates 51 and front plate 54 stand at right angles to the bottom plate 53.

The bottom plate 53 is formed with a plurality of slits 55*a*, 55*b* used to insert the inserting portions 32, 44 provided at the bottom ends of the width restricting guide 3*a* and rear end guide 4*a*. These slits 55*a*, 55*b* are formed in conformity with the respective sizes of the sheets P. Specifically, there are formed a plurality of slits 55*a*, 55*b* that come in two kinds, i.e. the slits 55*a* used to insert the width restricting guides 3*a*, 3*b* in the direction parallel to the sheet feeding direction and the slits 55*b* used to insert the rear end guides 4*a*, 4*b* in the direction normal to the sheet feeding direction. The bottom ends of the width restricting guides 3*a*, 3*b* and rear end guides 4*a*, 4*b* are supported by inserting the inserting portions 32 of the width restricting guides 3*a*, 3*b* into the slits 55*a* and inserting the inserting portions 44 of the rear end guides 4*a*, 4*b* into the slits 55*b*.

As shown in FIG. 3, the holes 31 formed at the upper ends of the width restricting guides 3*a*, 3*b* and the engaging portions 52 to be engaged with the engaging members 41 of the rear end guides 4*a*, 4*b* are provided on the upper ends of the side plates 51. The engaging portions 52 are engaged with the holes 31 of the width restricting guides 3*a*, 3*b* and the holes 43 of the engaging members 41 of the rear end guides 4*a*, 4*b*. An engaging method may be, for example, such that the engaging portions 52 in the form of projections are fitted into the holes 31, 43 or they may be engaged by screws. In this way, the upper ends of the width restricting guides 3*a*, 3*b* and rear end guides 4*a*, 4*b* are supported. Thus, the width restricting guides 3*a*, 3*b* and rear end guides 4*a*, 4*b* restrict the position of the sheets P while being reliably supported.

The front ends of the sheets P in the sheet feeding direction are held in contact with the front plate 54. The stacked sheets P are discharged toward the image forming apparatus 2 from the vicinity of the upper end of the front plate 54. Thus, the height of the front plate 54 is slightly lower than that of the side plates 51. The sheets P are fed through a section defined by this height difference. In other words, this section becomes the sheet discharge portion 56. The feeding unit 6 is arranged at the position of the sheet discharge port 56 although not shown in FIG. 3 in order to facilitate the description.

Further, the aforementioned elevating plate 10 is arranged in the sheet accommodating portion 5. In FIG. 3, the through holes 12, 13 formed in the elevating plate 10 are not shown except those in use. The sheets P stacked on the elevating plate 10 are reliably position-restricted by the width restricting guides 3*a*, 3*b*, the rear end guides 4*a*, 4*b* and the front plate 54 of the sheet accommodating portion 5. The sheets P of various sizes are position-restricted such that the center between the width restricting guides 3*a*, 3*b* conform to the pickup portion 61, i.e. the widthwise center of the sheets P touches the pickup portion 61.

Figure 4:
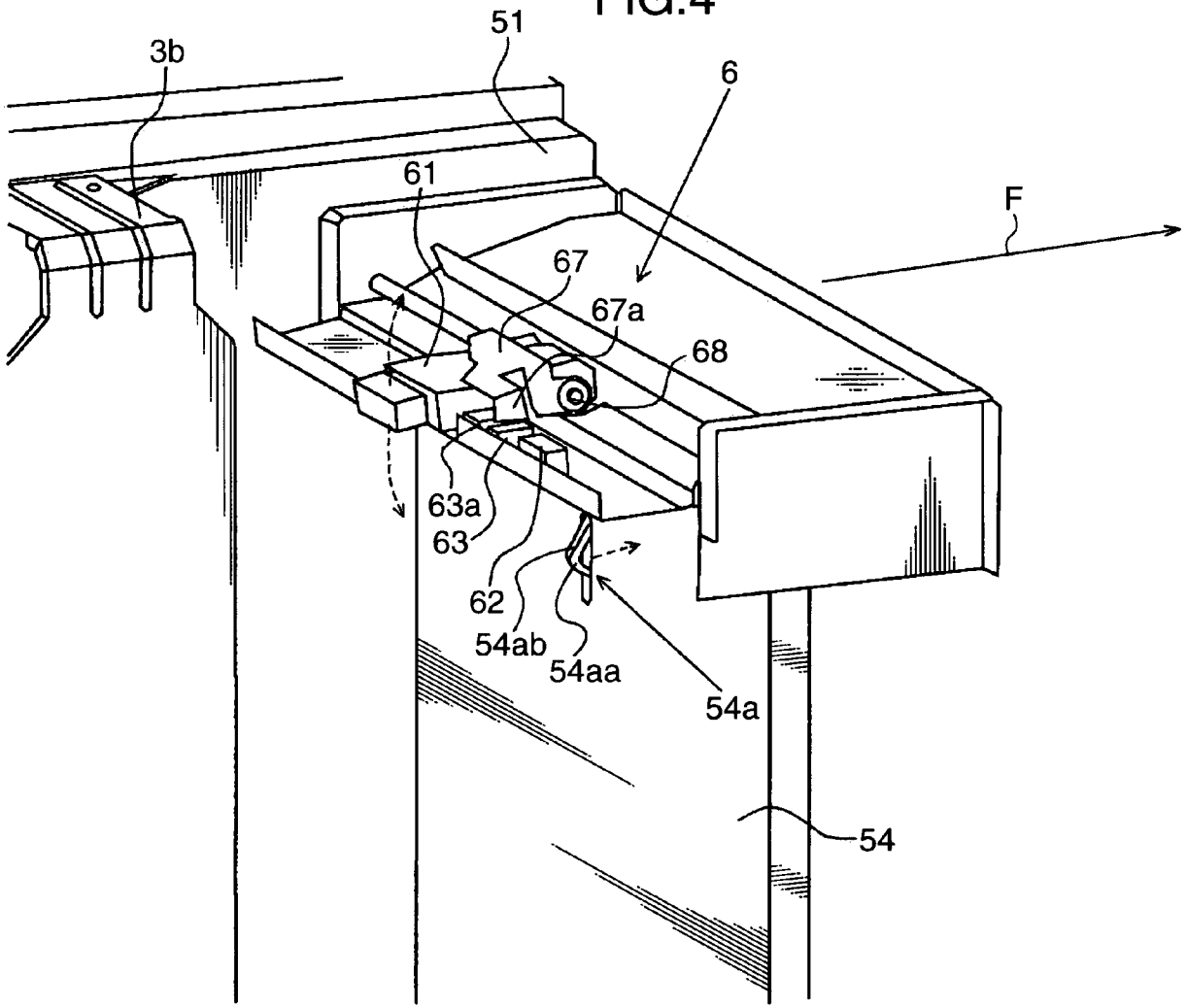
FIG. 4 is an enlarged perspective view of the sheet feeder when viewed from an upper left back side.
Figure 5:
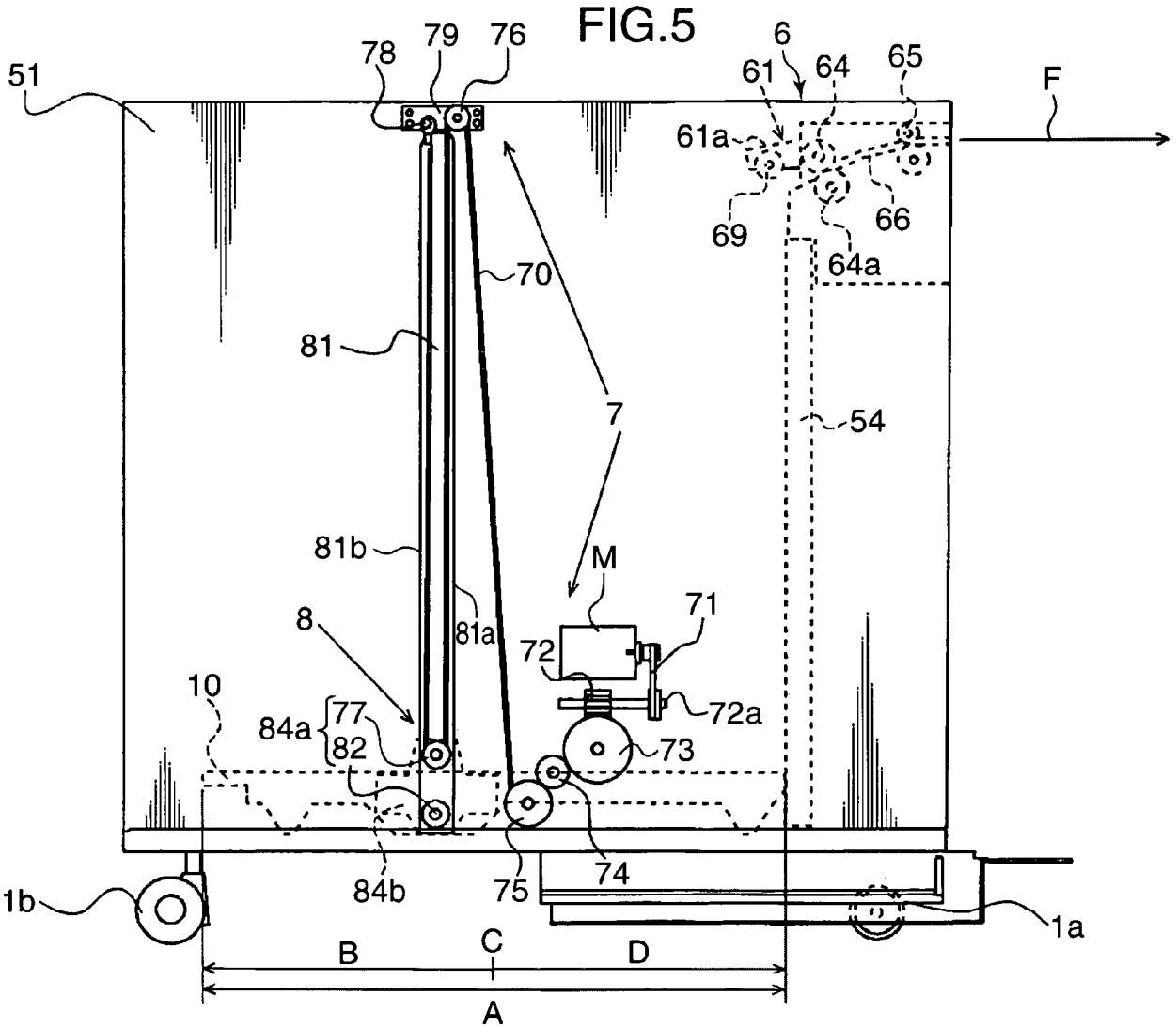
FIG. 5 is a side view of a sheet accommodating portion when viewed from the back side of the sheet feeder.

Next, the construction of the feeding unit 6 is described with reference to FIGS. 4 and 5. FIG. 4 is an enlarged perspective view of the sheet feeder 1 when viewed from an upper left back side showing the feeding unit 6 of the sheet feeder 1. FIG. 5 is a side view of the sheet accommodating portion 5 when viewed from a side of the side plate 51 located at the back side of the sheet feeder 1. In FIG. 4, the side plate 51 located at the front side is not shown in order to facilitate the description.

The feeding unit 6 is arranged at an upper part of the sheet feeder 1 before the sheets P in the sheet feeding direction (direction of the arrow F in FIG. 4). In other words, the feeding unit 6 is arranged at an upper part of the front plate 54 of the sheet accommodating portion 5. The feeding unit 6 is for feeding the stacked sheets P one by one from the sheet feeder 1 toward the image forming apparatus 2 and includes the pickup portion 61, a paper-out detection sensor 62, an upper limit detection sensor 63, conveyor roller pairs 64, 65, a sheet conveyance path 66 and the like.

First, the sensors provided in the sheet feeder 1 are described. These sensors are for detecting the stacked state of the sheets. As shown in FIG. 4, out of the two sensors to the right of the pickup portion 61 in the transverse direction of FIG. 4, the right one is the paper-out detection sensor 62 for detecting a paper-out condition. This paper-out detection sensor 62 is an optical sensor, emits a light toward the bottom surface of the sheet feeder 1, and includes a light receiving element (not shown) for detecting a reflected light. If any sheet P is present, the emitted light is reflected by the sheet P and detected by the light receiving element. On the other hand, the elevating plate 10 is formed with a through opening (not shown) at a position below the paper-out detection sensor 62. Thus, if there is no more sheet P, the reflected light that was received cannot be detected any longer with the sheets P stacked. The paper-out condition can be detected by this change.

On the other hand, out of the two sensors disposed to the right of the pickup portion 61 in the transverse direction of FIG. 4, the left one is the upper limit detection sensor 63 for detecting the uppermost position of the stacked sheet P. This upper limit detection sensor 63 is an optical sensor and has a recess-shaped cross section. As shown in FIG. 4, a light blocking member 67 for changing a light receiving state of the optical sensor in this recess 63*a* is so disposed as to cover the upper surface of the pickup portion 61.

The light blocking member 67 is for blocking light emitted in the recess 63*a*. As shown in FIG. 4, the light emitted in the recess 63*a* does not reach the light receiving element disposed in the recess 63*a* of the sensor with the insertable piece 67*a* provided at one end of the blocking member 67 inserted in the recess 63*a*. Further, the light blocking member 67 is supported on a supporting point 68 in a direction normal to the sheet feeding direction, and is pivotal upward and downward.

Here, the pickup portion 61 is supported on the same supporting point 68 as the light blocking member 67. If the uppermost one of the stacked sheets P comes into contact with the pickup portion 61 upon an upward movement of the elevating plate 10 and the elevating plate 10 continues to move upward, the pickup portion 61 is lifted upward. If this pickup portion 61 is lifted up, the light blocking member 67 is simultaneously lifted up. It should be noted that this pivoting direction is shown by a broken-line arrow in FIG. 4.

Then, the insertable piece 67*a* of the light blocking member 67 inserted in the recess 63*a* of the upper limit detection sensor 63 is lifted up to change a light receiving state of the sensor. By detecting this change, the uppermost position of the stacked sheets P is detected.

Here, a detecting member 54*a* (sheet detection switch 54*aa*) provided not in the sheet feeder 6, but at the front plate 54 is described in connection with the sensors.

As shown in FIG. 4, the sheet detection switch 54*aa* is disposed substantially in the widthwise center at an upper part of the front plate 54, i.e. disposed below the sheet feeder 6. This sheet detection switch 54*aa* is the detecting member 54*a* for detecting whether the front ends of the sheet P in the uppermost part of the sheet stack in the sheet feeding direction are in touch with the front plate 54.

The sheet detection switch 54*aa* is comprised of an actuator portion 54*ab* projecting from the front plate 54 and a sensor portion (not shown) provided in the front plate 54. When the front ends of the sheets P come into contact, the actuator portion 54*ab* of the sheet detection switch 54*aa* is pushed into the inside of the front plate 54. On the other hand, when the front ends of the sheets P are not in contact, the actuator portion 54*ab* projects. The sensor portion detects whether the actuator portion 54*ab* is projecting or pushed in. For example, an optical sensor can be used as the sensor portion.

When the sheets P are placed on the elevating plate 10 or placed on the uppermost one of the stacked sheets P on the elevating plate 10 upon the replenishment of sheets, the elevating plate 10 is lowered by a specified amount.

If the front ends of the stacked sheets P come into contact with the front plate 54 by the replenishment of sheets and the actuator portion 54*ab* of the sheet detection switch 54*aa* is pushed in, the sheet detection switch 54*aa* is recognized to be on. If the elevating plate 10 is lowered to bring the front ends of the sheets P in the uppermost part of the sheet stack out of contact with the actuator portion 54*ab* and the actuator 54*ab* projects from the front plate 54, the sheet detection switch 54*aa* is recognized to be off. Accordingly, there can be executed such a control as to lower the elevating plate 10 if the sheets P are replenished and the sheet detection switch 54*aa* is turned on and to stop a downward movement of the elevating plate 10 if the sheet detection switch 54*aa* is turned off. In other words, the sheet detection switch 54*aa* is used to properly determine an amount of the downward movement of the elevating plate 10.

Although the contact switch is shown in the above, a non-contact sensor or switch for detecting, for example, a reflected light may be used as the detecting member 54*a*.

Next, with reference to FIG. 5, the sheet feed of the sheet feeder 1 is described. In FIG. 5, the construction of the side plate 51 at the back which cannot be actually seen is shown in broken line. As shown at an upper right side of FIG. 5, the sheet feeder 6 is internally provided with the pickup portion 61, feed roller pairs 64, 65, sheet conveyance path 66 and the like as a construction for feeding sheets.

A pickup roller 69 is provided in the pickup portion 61. The pickup portion 61 is formed by mounting a cover 61*a* around the pickup roller 69. The pickup roller 69 picks the sheets P up one by one by coming into contact with the uppermost one of the stacked sheets P, and feeds the sheets P toward the image forming apparatus 2. Sheet feeding timings are controlled in accordance with control signals transmitted from the image forming apparatus 2 to the sheet feeder 1. The pickup roller 69 is driven to rotate in such a direction as to feed the sheets P by a driving mechanism (not shown).

The feed roller pairs 64, 65 are arranged downstream of the pickup roller 69 in the sheet feeding direction. Here, out of the feed roller pairs 64, 65, the one closer to the pickup roller 69 is the feed roller pair 64 and the one more distant is the feed roller pair 65.

The respective rollers in the feed roller pairs 64, 65 are driven to rotate in specified directions by the driving mechanism (not shown). The respective rollers of each feed roller pair 64, 65 form a nip therebetween, and the sheets P are conveyed through these nips. For example, in order to prevent the multiple feed of the sheets P, the lower one 64*a* of the rollers of the feed roller pair 64 can be rotated in a direction opposite to the sheet feeding direction.

Figure 6:
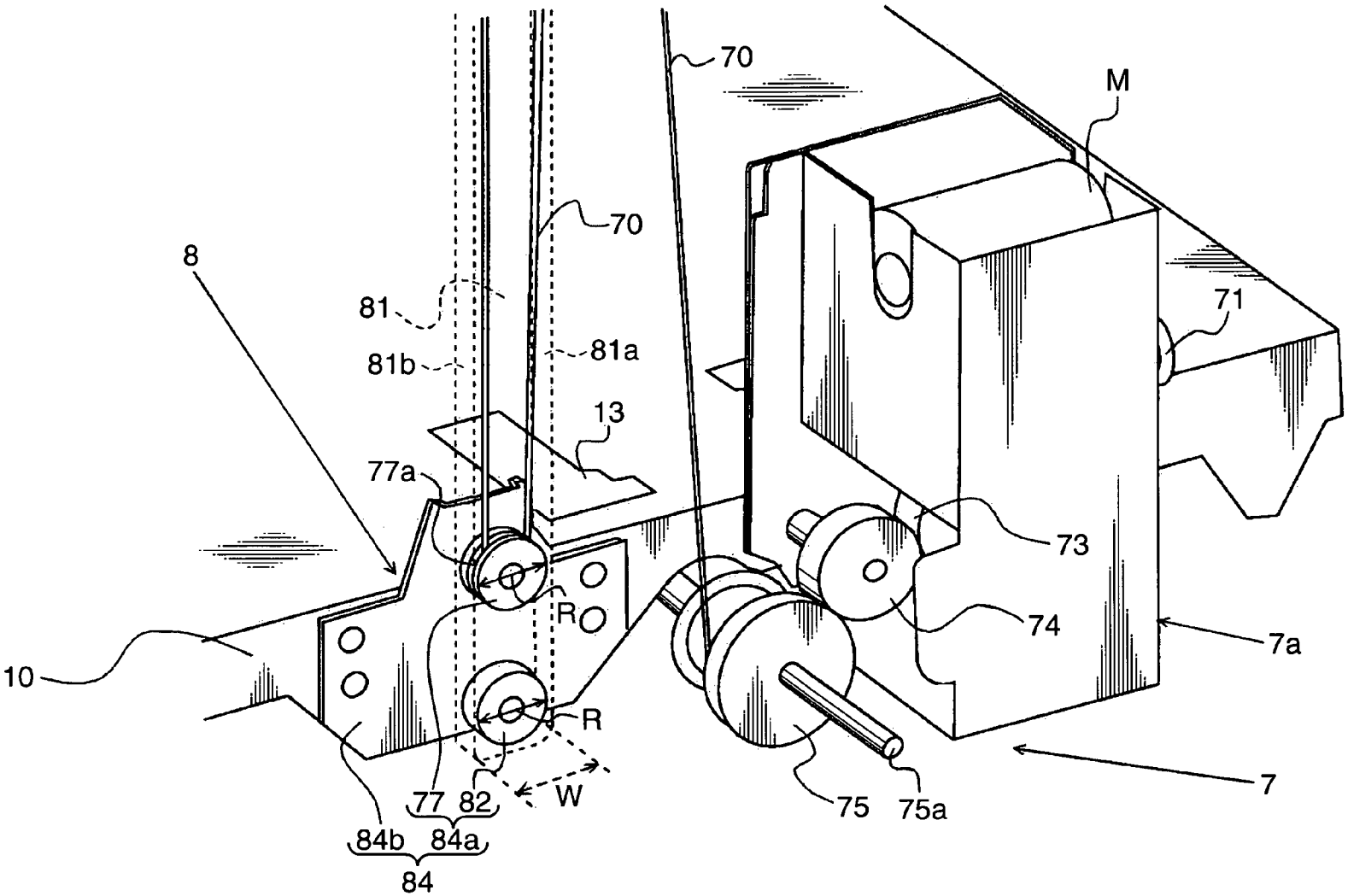
FIG. 6 is an enlarged perspective view showing an elevating mechanism and an inclining mechanism according to the embodiment of the invention.

Next, with reference to FIGS. 5 and 6, an elevating mechanism 7 for elevating the elevating plate 10 and an inclining mechanism 8 are described. FIG. 6 is an enlarged perspective view showing the elevating mechanism 7 and inclining mechanism 8 according to the embodiment of the present invention.

First, with reference to FIG. 5, the elevating mechanism 7 for elevating the elevating plate 10 is described. The elevating mechanism 7 includes a motor M as a driving source; and a wire 70 (hoisting member), an endless belt 71, a worm 72, a worm wheel 73, a gear 74, a take-up pulley 75, a pulley 76, a first roller 77 (support member), a securing member 78 and the like as a torque transmitting mechanism. These elements of the torque transmitting mechanism are mounted between the side plate 51 of the sheet accommodating portion 5 and the housing 1*d* of the sheet feeder 1 except the first roller 77, i.e. mounted outside the side plate 51 of the sheet accommodating portion 5.

The motor M is controlled to be rotatable in forward and reverse directions, and has the rotating direction thereof controlled depending on whether the elevating plate 10 is elevated or lowered. The endless belt 71 is for transmitting the torque to a rotary shaft 72*a* of the worm 72, and mounted between a rotary shaft of the motor M and the rotary shaft 72*a* of the worm 72. The worm 72 transmits the torque to the worm wheel 73. The worm wheel 73 transmits the torque to the gear 74. The gear 74 transmits the torque to the take-up pulley 75. In this way, the torque is transmitted from the motor M to the take-up pulley 75.

One end of the wire 70 is connected to the take-up pulley 75, and the other end is connected to the securing member 78 disposed near the upper edge of the side plate 51. The wire 70 is mounted on the pulley 76 disposed adjacent to the securing member 78 and the first roller 77 secured to the elevating plate 10. The wire 70 is mounted in the order of the take-up pulley 75, pulley 76, first roller 77 and securing member 78. Here, the pulley 76 and securing member 78 are supported or rotatably supported on a fixture 79 and secured at an upper part of the side plate 51 and above an opening 81.

The opening 81 is vertically formed from the upper side to the lower side of the side plate 51 to guide upward and downward movements of the elevating plate 10. The first roller 77 and a second roller 82 to be described later, which are secured to the elevating plate 10, are fitted in this opening 81.

Although not shown in FIG. 5, a take-up pulley 75, a pulley 76, a first roller 77, a second roller 82 and a securing member 78 are provided on the outer side of the other side plate 51 facing the side plate 51 shown in FIG. 5. Likewise, an opening 81 is formed in the other side plate 51. These elements are arranged in pairs on the opposite side plates 51. It should be noted that the both take-up pulleys 75 share a common drive shaft 75*a* (see FIG. 6). The drive shaft 75*a* is mounted to cross the bottom surface of the sheet feeder 1, and the both take-up pulleys 75 are simultaneously rotated. Accordingly, it is sufficient to provide only one set of the motor M, endless belt 71, worm 72, worm wheel 73, gear 74 and the like as the elevating mechanism 7.

When the motor M is rotated in such a direction that the take-up pulley 75 takes up the wire 70 and a drive force is transmitted, the take-up pulley 75 takes up the wire 70. Thus, the length of the mounted wire 70 becomes shorter and the elevating plate 10 is elevated. In order to lower the elevating plate 10 on the contrary, the motor M may be rotated in a direction opposite to the above direction.

Next, with reference to FIGS. 5 and 6, the elevating mechanism 7 and inclining mechanism 8 are described. The side plate 51 is not shown in FIG. 6 in order to facilitate the description. Further, the elevating plate 10 is lowered up to the bottommost position.

The motor M, endless belt 71, worm 72, worm wheel 73 and gear 74 constructing the elevating mechanism 7 are so accommodated in a box 7*a* as to be supported or pivotally supported. By doing so, the adherence of dust to tooth surfaces of the worm 72, worm wheel 73 and gear 74 can be avoided and the sheet feeder 1 can be more easily assembled by unitization.

The inclining mechanism 8 includes inclination holding members 84 and the openings 81 formed in the side plates 51. The inclination holding member 84 is comprised of the first roller 77 and second roller 82 as an engaging member 84*a*, and a mounting member 84*b* supporting the engaging member 84*a* and secured to the elevating plate 10.

As described above, the opening 81 formed in the side plate 51 functions as a guide when the elevating plate 10 is elevated and lowered, and the wire 70 is mounted on the first roller 77. Thus, the inclining mechanism 8 constitutes a part of the elevating mechanism 7. Accordingly, it is not necessary to provide the inclining mechanism 8 extra in addition to the elevating mechanism 7 and the construction of the sheet feeder 1 is simplified, which is advantageous in terms of costs and productivity. It should be noted that the first roller 77 is formed with a groove 77*a* and the wire 70 is fitted into this groove 77*a*.

The first and second rollers 77, 82 as the engaging member 84*a* are rotatably supported on one mounting member 84*b* and arranged one above the other. The mounting member 84*b* is secured to the side surface of the elevating plate 10. The positional relationship of the first and second rollers 77, 82 are such that the first roller 77 is located vertically above the second roller 82. The mounting member 84*b* is so secured to the elevating plate 10 that the rotary shafts of the first and second rollers 77, 82 are fitted in a direction perpendicular to the side plate 51.

Each opening 81 is formed from the top side to the bottom side of the corresponding side plate 51. The first and second rollers 77, 82 as the engaging member 84*a* are fitted in this opening 81. Width W of the openings 81 in horizontal direction is wider than outer diameters R of the first and second rollers 77, 82. It should be noted that the outer diameters R of the first and second rollers 77, 82 shown in FIG. 6 are equal.

In other words, the outer diameters R of the first and second rollers 77, 82 are shorter than the width W of the opening 81. By this length difference, the elevating plate 10 is inclined downward with respect to a direction parallel to the sheet feeding direction F. However, the outer circumferential surfaces of the first rollers 77 at one side come into contact with vertical first edges 81*a* forming the openings 81 and those of the second rollers 82 at a side opposite to the contact side of the first rollers 77 come into contact with second edges 81*b* of the openings 81 facing the first edges 81*a*, whereby the elevating plate 10 has the inclination thereof restricted so as not to be inclined beyond a specific angle.

Each opening 81 is so formed in the side plate 51 as to be located at a side B behind a center C of an entire length A of the elevating plate 10 in the sheet feeding direction (see FIG. 5). Here, a center of gravity of the elevating plate 10 is assumed to be located at the position of the center C in this embodiment. The center of gravity of the elevating plate 10 needs not always be located in the center C, and may be deviated from the center C depending on the shape of the elevating plate 10 and the presence of the through holes 12, 13. In such a case, the position of the opening 81 may be displaced backward from the deviated center of gravity with respect to the sheet feeding direction.

By forming the openings 81 at positions displaced toward the rear ends of the sheets from the center of gravity of the elevating plate 10 with respect to the sheet feeding direction, the front ends of the stacked sheets P are always inclined downward by the action of gravity even if the sheets P of various sizes are placed on the elevating plate 10. The angle of inclination can be adjusted by the positions and the outer diameters R of the first and second rollers 77, 82 and the width W of the opening 81 and can be suitable set. For example, it is considered not to set an excessively large angle of inclination since a sheet jam is likely to occur if the elevating plate 10 is excessively inclined. For example, the elevating plate 10 can be regulated to be inclined downward by about 1 to 5°.

It should be noted that each opening 81 may also be formed at the center C (center of gravity) of the entire length A of the elevating plate 10 with respect to the sheet feeding direction or at a side D located before the center C (center of gravity) with respect to the sheet feeding direction. In such a case, a mounting angle of the mounting member 84*b* rotatably supporting the first and second rollers 77, 82 may be, for example, adjusted such that a straight line extending from the center of the second roller 82 toward that of the first roller 77 is not vertical and the center of the second roller 82 is slightly shifted toward the rear ends of the sheets. By such a method, the front side of the elevating plate 10 with respect to the sheet feeding direction can be inclined downward.

The interference of the elevating plate 10 with the width restricting guides 3*a*, 3*b* and rear end guides 4*a*, 4*b* might hinder the movement of the elevating plate 10. Accordingly, sufficient widths are ensured for the through holes 12, 13 lest the elevating plate 10 and the width restricting guides 3*a*, 3*b* and rear end guides 4*a*, 4*b* should interfere with each other.

Since the front ends of the sheets P stacked on the elevating plate 10 are constantly inclined downward, the sheets P can be constantly stacked at a proper position without being displaced toward the rear ends of the sheets. When the elevating plate 10 is elevated to constantly bring the uppermost sheet P into contact with the pickup roller 69, the position of the pickup roller 69 becomes proper. In other words, the pickup roller 69 comes to be positioned such that the picked-up sheet P can be properly fed to the feed roller pair 64 and the sheet conveyance path 66. Accordingly, troubles such as sheet jams and sheet feeding timing errors during the sheet feeding can be solved. Further, since the uppermost part of the stacked sheets P can be precisely detected by the sheet detection switch 54*aa*, there is no likelihood of troubling the sheet replenishing operation due to an insufficient downward movement of the elevating plate 10 to stop at an undesired position on the way to the desired one.

To make doubly sure, although only one side plate 51 is shown in FIG. 6 for the sake of convenience, the inclining mechanism 8 is provided at the two side plates 51 extending in the direction parallel to the sheet feeding direction to face each other and at the opposite side surfaces of the elevating plate 10 to face each other.

Here, the operation of the sheet feeder 1 during the replenishment of sheets is described. As described above, the sheet feeder 1 according to this embodiment can accommodate about four thousands sheets P although it depends on the thickness of the sheets P. Generally, 500 copy sheets are packaged. Accordingly, the sheet feeder 1 according to this embodiment can accommodate eight packages of copy sheets.

When a user replenishes the sheets P, he or she first opens the lid 1*c* provided atop the sheet feeder 1. By doing so, a hollow part of the sheet feeder 1 is exposed to the above, so that the sheets P can be replenished into the sheet accommodating portion 5. Here, the elevating plate 10 is lowered in conformity with the remaining amount of the sheets P. Specifically, the motor M is rotated to determine an amount of downward movement of the elevating plate 10 during the lapse of several seconds after the sheet detection switch 54*aa* is turned off. Since a period during which the motor M is kept rotated after the sheet detection switch 54*aa* is turned off is determined by various factors such as the height at which the downward movement of the elevating plate 10 is tended to be stopped, the position of the sheet detection switch 54*aa* and a downward moving speed of the elevating plate 10, this period can be suitably set. Accordingly, the rotation of the motor M may also be stopped immediately after the sheet detection switch 54*aa* is turned off.

Here, since the sheet feeder 1 of this embodiment is capable of accommodating a great number of sheets, it is difficult to perform the sheet replenishing operation if the elevating plate 10 is lowered straight to the lower limit position. Accordingly, a state where the downward movement is stopped is a state where the height of the stacked sheets P or that of the elevating plate 10 is such a height at which the user can easily place the sheets P.

Since the user cannot replenish as many sheets as four thousands at once, he or she repeatedly replenish the sheets, for example, by replenishing five hundreds sheets each time. Accordingly, the sheet feeder 1 of this embodiment lowers the elevating plate 10 by a specified amount as the sheets P are replenished. The sheet detection switch 54*aa* is also used for the control of the motor M accompanying this downward movement. By the detection of this sheet detection switch 54*aa*, the rotation of the motor M is controlled such that the uppermost one of the already stacked sheets P is at such a height as to enable easy replenishment. In other words, the motor M is driven if the sheet detection switch 54*aa* is on, whereas the driving of the motor M is stopped upon the lapse of several seconds after the sheet detection switch 54*aa* is turned off. The replenishment of the sheets P can be repeated until the elevating plate 10 reaches a lowest permissible level.

When the user closes the lid 1*c* of the sheet feeder 1, the elevating plate 10 is elevated as much as necessary. Specifically speaking, the elevating plate 10 is elevated until the uppermost one of the stacked sheets P comes into contact with the pickup portion 61. The control of the motor M accompanying this upward movement of the elevating plate 10 is executed by the aforementioned upper limit detection sensor 63. In other words, the motor M is driven while the insertable piece 67*a* of the light blocking member 67 is blocking light, and the driving of the motor M is stopped when the light blocking member 67 is lifted up to lift the insertable piece 67*a* up from the recess 63*a*, thereby being no longer able to block light.

As described above, the sheet feeder 1 of this embodiment is attached to the image forming apparatus 2, is provided with the sheet accommodating portion 5 including the bottom plate 53 and a plurality of side plates 51 perpendicular to the bottom plate 53 in order to accommodate a plurality of sheets P, and successively feeds the sheets to the image forming apparatus 2 from the uppermost one of the accommodated sheets. In the sheet feeder 1, the elevating plate 10 movable upward and downward and adapted to carry the sheets is provided in the sheet accommodating portion 5, and the inclining mechanism 8 for inclining the elevating plate 10 is so provided that the front ends of the sheets P are inclined downward in the sheet feeding direction.

Since the front ends of the sheets P are inclined downward in the sheet feeding direction, the sheets P in the sheet feeder 1 can be constantly stacked at a proper position without being displaced toward the rear ends of the sheets due to the weight thereof unlike the prior art. Thus, the uppermost sheet P can be precisely picked up out of the sheets stacked in the sheet feeder 1, and there is no likelihood of sheet jam and the like.

The sheet accommodating portion 5 includes the front plate 54 which is provided perpendicular to the bottom plate and with which the front ends of the stacked sheets P in the sheet feeding direction are in touch. The sheet detection switch 54*aa* as the detecting member 54*a* for detecting whether or not the front ends of the sheets P in the uppermost part of the sheet stack with respect to the sheet feeding direction are in touch is provided on this front plate 54. Thus, the front ends of the stacked sheets P are inclined downward in the sheet feeding direction and the sheets P are not displaced toward the rear ends of the sheets. Therefore, the position of the uppermost part of the sheets P can be reliably detected. Accordingly, an insufficient downward movement can be prevented if the elevating plate 10 is lowered in accordance with a signal from the sheet detection switch 54*aa*.

The inclining mechanism 8 includes a pair of openings 81 vertically extending and formed in the both side plates 51 which are opposite to each other and extend in the direction parallel to the sheet feeding direction, and the inclination holding members 84 provided at the opposite side surfaces of the elevating plate 10 extending in the direction parallel to the sheet feeding direction and engageable with the openings 81. The openings 81 are formed at such positions located behind the center of gravity (assumed to be the center C in this embodiment) of the elevating plate 10 with respect to forward and backward directions, i.e. the sheet feeding direction. Each inclination holding member 84 is comprised of the engaging member 84*a* (first and second rollers 77, 82) fittable into the opening 81, and the mounting member 84*b* supporting the engaging member 84*a* and secured to the elevating plate 10. The width of the engaging member 84*a* is set narrower than the width W of the opening 81.

By having the above construction, the angle of inclination of the elevating plate 10 can be kept constant. Accordingly, there is even less likelihood of swinging the sheets P stacked in the sheet accommodating portion 5 and displacing the sheets P toward the rear ends of the sheets, wherefore the sheet feeder 1 free from a sheet jam and the like can be provided. Further, although it might be thought to fix the elevating plate 10 at a specified angle, there are cases where the suitable position or angle of inclination of the elevating plate 10 cannot be obtained due to a fabrication error and the like. Contrary to this, since the elevating plate 10 is inclined due to the weight thereof in the present invention, the above errors can be absorbed.

The engaging member 84*a* includes two rollers disposed one above the other, i.e. the first and second rollers 77, 82, wherein the wire 70 used to elevate and lower the elevating plate 10 is placed on the first roller 77. The openings 81 serve as guides upon moving the elevating plate 10 upward and downward, and the inclining mechanism 8 constitutes a part of the elevating mechanism 7. According to such a construction, since the inclining mechanism 8 doubles as the part of the elevating mechanism 7, it is not necessary to specially provide the inclining mechanism 8 in addition to the mechanism for elevating and lowering the elevating plate 10 and the construction of the sheet feeder 1 can be simplified. Therefore, this construction is advantageous in terms of costs and productivity.

Although the embodiment of the present invention is described above, the scope of the present invention is not limited to this and various changes can be made without departing from the gist of the present invention. For example, although the elevating mechanism 7 uses the wire 70, any construction will do provided that it functions as the elevating mechanism 7.

The specific embodiment described above mainly embraces inventions having the following constructions.

A sheet feeder according to one aspect of the present invention comprises a sheet accommodating portion including a bottom plate and a plurality of side plates provided perpendicular to the bottom plate, and being capable of accommodating a plurality of sheets, the accommodated sheets being successively fed to the outside from the uppermost one; an elevating plate provided to stack the sheets in the sheet accommodating portion and movable upward and downward; and an inclining mechanism for inclining the elevating plate such that the front ends of the sheets are inclined downward in a sheet feeding direction during sheet feeding.

An image forming apparatus according to another aspect of the present invention comprises an apparatus main body for performing an image forming operation to sheets; and a sheet feeder for feeding the sheets to the apparatus main body, wherein the sheet feeder has the construction of the above sheet feeder.

According to the above sheet feeder or image forming apparatus, there is no likelihood of displacing the stacked sheets toward the rear ends thereof due to the weight of the stacked sheets as in prior art sheet feeders since the front ends of the sheets with respect to the sheet feeding direction are inclined downward. In other words, the sheets are constantly stacked at a proper position. Therefore, there is no likelihood of a sheet jam and the like since the uppermost one of the sheets stacked in the sheet feeder is precisely picked up.

In the above construction, the elevating plate is preferably inclined downward in the sheet feeding direction within a range of 1 to 5° with respect to horizontal direction. Further, the elevating plate is preferably inclined downward by the weight of the stacked sheets.

In the above construction, the inclining mechanism preferably includes a support member for pivotally supporting the elevating plate on both sides thereof extending in a direction parallel to the sheet feeding direction, the support member being provided on the elevating plate at a position that is in the rear of a center of gravity of the elevating plate with respect to the sheet feeding direction. According to this construction, the elevating plate can be readily inclined merely by placing sheets on the elevating plate.

In the above construction, it is preferable to further comprise a front plate which is provided perpendicular to the bottom plate of the sheet accommodating portion and with which the front ends of the stacked sheets with respect to the sheet feeding direction are in touch, and a detecting member for detecting whether or not the front ends of the sheets in an uppermost part of the stacked sheets with respect to the sheet feeding direction are in touch with the front plate.

According to this construction, the sheets stacked on the elevating plate are not displaced toward the rear ends of the sheets with the front ends thereof with respect to the sheet feeding direction inclined downward, wherefore the position of the uppermost sheet can be reliably detected if the detecting member is so disposed as to be brought into contact with the front ends of the sheets. Therefore, an insufficient downward movement of the elevating plate can be prevented if the elevating plate is lowered in accordance with a signal from this detecting member.

In the above construction, it is preferable that the inclining mechanism includes openings extending vertically and formed in the side plates which are opposite to each other and extend in a direction parallel to the sheet feeding direction and inclination holding members provided at the opposite side surfaces of the elevating plate extending in the direction parallel to the sheet feeding direction and fittable into the openings; that each inclination holding member includes an engaging member engageable with the corresponding opening and a mounting member supporting the engaging member and securing the engaging member to the elevating plate and the width of the engaging members is narrower than that of the openings.

In this case, it is preferable that the openings are formed in the opposite side plates at positions that are in the rear of a center of gravity of the elevating plate with respect to the sheet feeding direction.

According to this construction, an angle of inclination of the elevating plate can be kept constant. Accordingly, there is even less likelihood of swinging the sheets stacked in the sheet accommodating portion and displacing the sheets toward the rear ends thereof, wherefore a sheet feeder free from a sheet jam and the like can be provided. Further, although it might be thought to fix the elevating plate at a specified angle, there are cases where a suitable position or angle of inclination of the elevating plate cannot be obtained due to a fabrication error and the like. Contrary to this, according to the present invention, since the elevating plate is inclined due to the weight thereof, the above errors can be absorbed.

In the above construction, it is preferable that each engaging member includes a first roller disposed at an upper position and a second roller disposed at a position vertically below the first roller; and that the elevating plate is inclined with the inclination thereof restricted by hoisting the first rollers by means of specified hoisting members to bring a part of the surface of each of the first rollers into contact with a first edge of the corresponding opening while bringing a part of the surface of each of the second rollers into contact with a second edge of the corresponding opening facing the first edge, the surface part of the second roller being on the opposite to the surface part of the first roller.

In this case, it is preferable that a wire used to elevate and lower the elevating plate is placed on the first roller; that the openings serve as guides upon elevating and lowering the elevating plate; and the inclining mechanism constitutes a part of the elevating mechanism for elevating and lowering the elevating plate.

According to this construction, since the inclining mechanism doubles as the part of the mechanism for elevating and lowering the elevating plate, it is not necessary to specially provide an inclining mechanism in addition to the mechanism for elevating and lowering the elevating plate and the construction of the sheet feeder can be simplified. Therefore, this construction is advantageous in terms of costs and productivity.

This application is based on patent application No. 2006-265781 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet feeder, comprising:

a sheet accommodating portion including a bottom plate and a plurality of side plates provided perpendicular to the bottom plate, and being capable of accommodating a plurality of sheets, the accommodated sheets being successively fed to the outside from the uppermost one;

an elevating plate provided to stack the sheets in the sheet accommodating portion and movable upward and downward, the elevating plate having opposite first and second sides extending substantially parallel to a sheet feeding direction; and an inclining mechanism including first and second support members disposed respectively on the first and second sides of the elevating plate for pivotally supporting the elevating plate and inclining the elevating plate such that the front ends of the sheets are inclined downward in a sheet feeding direction during sheet feeding, the first and second support members positioned rearward of a center of gravity of the elevated plane with respect to the sheet feeding direction, wherein the first and second support members provide the only pivotal support of the elevating plate and being disposed so that the elevating plate is inclined downward by a weight of the stacked sheets.

2. A sheet feeder according to claim 1, wherein the elevating plate is inclined downward in the sheet feeding direction within a range of 1 to 5° with respect to horizontal direction.

3. A sheet feeder according to claim 1, further comprising:

a front plate which is provided perpendicular to the bottom plate of the sheet accommodating portion and with which the front ends of the stacked sheets with respect to the sheet feeding direction are in touch; and a detecting member for detecting whether or not the front ends of the sheets in an uppermost part of the stacked sheets with respect to the sheet feeding direction are in touch with the front plate.

4. A sheet feeder according to claim 1, wherein:

the inclining mechanism includes:

openings extending vertically and formed in the side plates which are opposite to each other and extend in a direction parallel to the sheet feeding direction, and inclination holding members provided at the opposite side surfaces of the elevating plate extending in the direction parallel to the sheet feeding direction and fittable into the openings; wherein each inclination holding member includes an engaging member engageable with the corresponding opening and a mounting member supporting the engaging member and securing the engaging member to the elevating plate, and the width of the engaging members is narrower than that of the openings.

5. A sheet feeder according to claim 4, wherein the openings are formed in the opposite side plates at positions that are in the rear of a center of gravity of the elevating plate with respect to the sheet feeding direction.

6. A sheet feeder, comprising:

a sheet accommodating portion including a bottom plate and two opposite side plates provided perpendicular to the bottom plate and parallel to a sheet feeding direction, the sheet accommodating portion being capable of accommodating a plurality of sheets, the accommodated sheets being successively fed to the outside from the uppermost one;

an elevating plate provided to stack the sheets in the sheet accommodating portion and movable upward and downward; and an inclining mechanism for inclining the elevating plate such that front ends of the sheets are inclined downward in the sheet feeding direction during sheet feeding, wherein the inclining mechanism includes:

openings extending vertically in the side plates, and inclination holding members provided at the opposite side surfaces of the elevating plate extending in the direction parallel to the sheet feeding direction and fittable into the openings; wherein each inclination holding member includes an engaging member engageable with the corresponding opening and a mounting member supporting the engaging member and securing the engaging member to the elevating plate, and the width of the engaging members is narrower than that of the openings the openings are formed in the opposite side plates at positions that are in the rear of a center of gravity of the elevating plate with respect to the sheet feeding direction, each engaging member includes a first roller disposed at an upper position and a second roller disposed at a position vertically below the first roller; and the elevating plate is inclined with the inclination thereof restricted by hoisting the first rollers by means of specified hoisting members to bring a part of the surface of each of the first rollers into contact with a first edge of the corresponding opening while bringing a part of the surface of each of the second rollers into contact with a second edge of the corresponding opening facing the first edge, the surface part of the second roller being on the opposite to the surface part of the first roller.

7. A sheet feeder according to claim 6, wherein:

a wire used to elevate and lower the elevating plate is placed on the first roller;

the openings serve as guides upon elevating and lowering the elevating plate; and the inclining mechanism constitutes a part of the elevating mechanism for elevating and lowering the elevating plate.

8. An image forming apparatus, comprising:

an apparatus main body for performing an image forming operation to sheets; and a sheet feeder for feeding the sheets to the apparatus main body, wherein the sheet feeder includes:

a sheet accommodating portion including a bottom plate and a plurality of side plates provided perpendicular to the bottom plate, and being capable of accommodating a plurality of sheets, the accommodated sheets being successively fed to the outside from the uppermost one;

an elevating plate provided to stack the sheets in the sheet accommodating portion and movable upward and downward, the elevating plate having opposite first and second sides extending substantially parallel to a sheet feeding direction; and an inclining mechanism including first and second support member disposed respectively on the first and second sides of the elevating plate for pivotally supporting the elevating plate and inclining the elevating plate such that the front ends of the sheets are inclined downward in a sheet feeding direction during sheet feedings, the first and second support members positioned rearward of a center of gravity of the elevated plane with respect to the sheet feeding direction, wherein the first and second support members provide the only pivotal support of the elevating plate and being disposed so that the elevating plate is inclined downward by a weight of the stacked sheets.

9. An image forming apparatus according to claim 8, wherein the elevating plate is inclined downward in the sheet feeding direction within a range of 1 to 5° with respect to horizontal direction.

10. An image forming apparatus according to claim 8, further comprising:

a front plate which is provided perpendicular to the bottom plate of the sheet accommodating portion and with which the front ends of the stacked sheets with respect to the sheet feeding direction are in touch; and a detecting member for detecting whether or not the front ends of the sheets in an uppermost part of the stacked sheets with respect to the sheet feeding direction are in touch with the front plate.

11. An image forming apparatus according to claim 8, wherein:

the inclining mechanism includes:

openings extending vertically and formed in the side plates which are opposite to each other and extend in a direction parallel to the sheet feeding direction, and inclination holding members provided at the opposite side surfaces of the elevating plate extending in the direction parallel to the sheet feeding direction and fittable into the openings;

each inclination holding member includes an engaging member engageable with the corresponding opening and a mounting member supporting the engaging member and securing the engaging member to the elevating plate; and the width of the engaging members is narrower than that of the openings.

12. An image forming apparatus according to claim 11, wherein the openings are formed in the opposite side plate at positions that are in the rear of a center of gravity of the elevating plate with respect to the sheet feeding direction.

13. An image forming apparatus according to claim 12, wherein:

each engaging member includes a first roller disposed at an upper position and a second roller disposed at a position vertically below the first roller; and the elevating plate is inclined with the inclination thereof restricted by hoisting the first rollers by means of specified hoisting members to bring a part of the surface of each of the first rollers into contact with a first edge of the corresponding opening while bringing a part of the surface of each of the second rollers into contact with a second edge of the corresponding opening facing the first edge, the surface part of the second roller being on the opposite to the surface part of the first roller.

14. An image forming apparatus according to claim 13, wherein:

a wire used to elevate and lower the elevating plate is placed on the first roller;

the openings serve as guides upon elevating and lowering the elevating plate; and the inclining mechanism constitutes a part of the elevating mechanism for elevating and lowering the elevating plate.

* * * * *